US008038341B2

(12) United States Patent
Reynard

(10) Patent No.: US 8,038,341 B2
(45) Date of Patent: Oct. 18, 2011

(54) UNIT THAT COMPRISES A WINDING RATCHET THAT IS ATTACHED TO A BARREL ARBOR AND BARREL ARBOR FOR THIS UNIT

(75) Inventor: Beranger Reynard, Grand Combe Chateleu (FR)

(73) Assignee: Francois Durafourg, Perroy (CH)

( * ) Notice: Subject to any disclaimer, the term of this patent is extended or adjusted under 35 U.S.C. 154(b) by 5 days.

(21) Appl. No.: 12/622,671

(22) Filed: Nov. 20, 2009

(65) Prior Publication Data

US 2010/0149928 A1 Jun. 17, 2010

(30) Foreign Application Priority Data

Dec. 15, 2008 (CH) ..... 1962/08

(51) Int. Cl.
*G04B 3/00* (2006.01)
*G04B 23/00* (2006.01)

(52) U.S. Cl. ..... 368/147; 368/206

(58) Field of Classification Search ..... 368/143, 368/147, 148, 152, 206, 208, 213–216
See application file for complete search history.

(56) References Cited

U.S. PATENT DOCUMENTS

| | | | | | |
|---|---|---|---|---|---|
| 424,185 | A * | 3/1890 | Donne | 368/147 |
| 1,339,941 | A * | 5/1920 | Borresen | 368/142 |
| 2,903,844 | A * | 9/1959 | Reymond | 368/147 |
| 3,119,227 | A * | 1/1964 | Stamm | 368/206 |
| 3,846,974 | A * | 11/1974 | Giger | 368/144 |
| 3,893,290 | A * | 7/1975 | Fluck et al. | 368/208 |
| 3,974,639 | A * | 8/1976 | Gilomen et al. | 368/142 |

* cited by examiner

*Primary Examiner* — Vit Miska
(74) *Attorney, Agent, or Firm* — Young & Thompson

(57) ABSTRACT

A unit is formed by a winding ratchet (1) and a barrel arbor (4) having an end which includes a non-circular driving formation (5) and a groove (6) adjacent thereto that defines a small-section portion whose shape and dimensions are such that they extend into the section of the driving formation, whereby a shoulder (18) of the barrel arbor limits the height of the groove. The ratchet includes a central opening (2) corresponding to the driving formation and at least one off-centered tapping (3) relative to the ratchet. It includes an attachment washer (8) having a central passage (9) corresponding to the driving formation and engaged therewith in an assembled position, and at least one off-centered piercing (10), at least one screw for screwing the attachment washer onto the ratchet in a position angularly offset so that in this assembled position, the central opening is not aligned with the central passage.

11 Claims, 4 Drawing Sheets

UNIT THAT COMPRISES A WINDING RATCHET THAT IS ATTACHED TO A BARREL ARBOR AND BARREL ARBOR FOR THIS UNIT

FIELD OF THE INVENTION

This invention has as its object a unit that comprises a winding ratchet that is attached to a barrel arbor, as well as a barrel arbor that is designed to be part of a timepiece.

BACKGROUND OF THE INVENTION

In top-quality timepieces, in particular in those where all or part of the movement is made visible, the winding ratchet comprises a square drive opening in which the end square of the barrel arbor is housed. This winding ratchet is then screwed in using three screws, generally into the terminal surface of the barrel arbor as it is depicted in FIG. 6.

This method is particularly aesthetic but involves the drawback of requiring a large-diameter barrel arbor that uselessly occupies a large volume of the inside space of the barrel cage, which makes it necessary to limit the length and the number of coils of the barrel spring for a barrel cage of a given diameter. The result is a reduction in the operating reserve or an increase in the diameter of the barrel cage and therefore the amount of space it requires. The result is also a weight increase of the barrel arbor.

SUMMARY OF THE INVENTION

This invention has as its object producing a device for attachment of a winding ratchet to a barrel shaft that makes it possible to obtain a unit that has the same aesthetics as a ratchet that is screwed into the terminal surface of a barrel arbor while making it possible to reduce the diameter of the barrel arbor to a minimum value for a given spring thickness, thus ensuring a minimum space requirement of the barrel, a large operating reserve, and a reduction in the weight of the barrel arbor.

This invention has as its object a unit that is formed by a winding ratchet and a barrel arbor, characterized by the fact that one of the ends of the barrel arbor comprises a driving formation that is non-circular in shape as well as a groove that is adjacent to this driving formation that defines a small-section portion of the barrel arbor whose shape and dimensions are such that they extend into the section of the driving formation, whereby a shoulder of the barrel arbor limits the height of said groove from the side facing said driving formation; by the fact that the ratchet comprises a central opening with a shape and dimension corresponding to the driving formation of the barrel arbor; by the fact that this ratchet comprises at least one off-centered tapping relative to the ratchet by a determined distance; by the fact that it comprises an attachment washer that has a central passage with a shape and dimension that correspond to the driving formation of the barrel arbor and is engaged with the latter in assembled position, as well as at least one off-centered piercing relative to said washer by a predetermined distance that is equal to the off-centering of the tapping of the ratchet; by the fact that it also comprises at least one screw that makes it possible to screw the attachment washer onto the ratchet; and by the fact that the angular positions of the piercings of the ratchet, relative to an axis of symmetry of its central opening, are different from an angle of the angular position that the tappings of the attachment washer exhibit relative to the corresponding axis of symmetry of the central passage of this attachment washer.

The invention also has as its object a barrel arbor that is part of the unit according to claim 1, characterized by the fact that it comprises a median part that is designed to accommodate the internal coil of a barrel spring that is located between two cylindrical portions that serve as a bearing for the box and the cover of a barrel, whereby one of these cylindrical portions is terminated by a pivot that forms one of the ends of the barrel arbor that is designed to pivot the barrel arbor in a platen of a clock movement; and by the fact that the other one of these cylindrical portions is separated by a driving element that is non-circular in shape and that forms the other end of the barrel arbor by a groove whose inside diameter is less than the circle that is inscribed in the form of the driving element and whose height corresponds to the thickness of a ratchet that has to be attached to the barrel arbor.

BRIEF DESCRIPTION OF THE DRAWINGS

Diagrammatically and by way of example, the accompanying drawing illustrates an embodiment of the unit that comprises a winding ratchet that is attached to a barrel arbor.

DETAILED DESCRIPTION OF THE INVENTION

Figure 6:
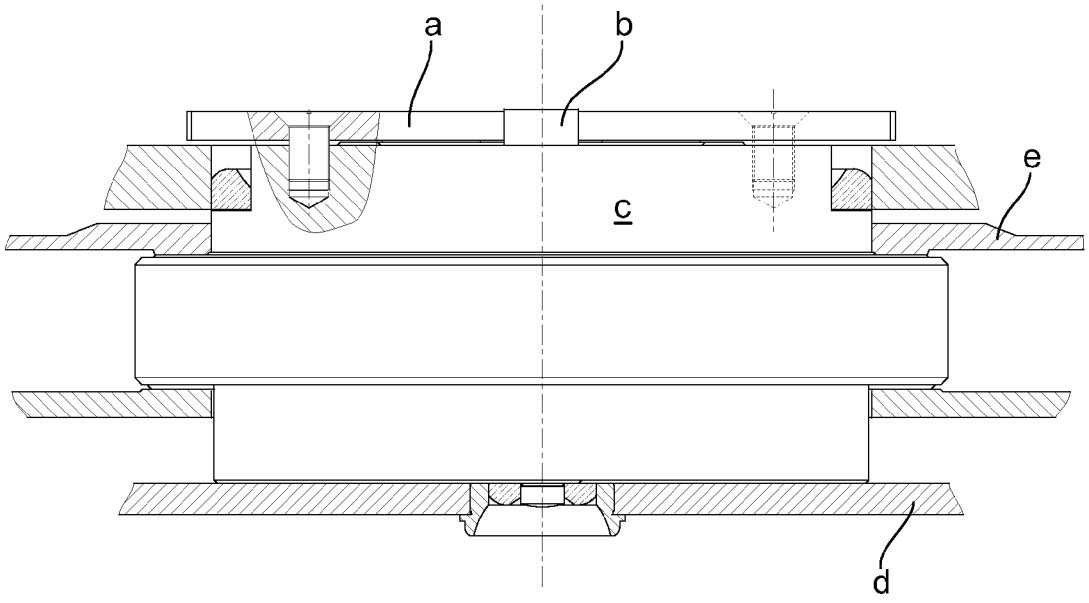
FIG. 6 illustrates the attachment of a winding ratchet to a barrel arbor as it is usually done in top-quality clock movements.

As depicted in FIG. 6, the barrel ratchet a, driven by a square b, forming one end of the barrel arbor c, is screwed in—using screw d—directly into the terminal surface of the barrel arbor c that is pivoted between the platen d and the barrel bridge e. This type of attachment is generally used in the top-quality clock movements where the winding ratchet is visible. This attachment, with its three screws offset by 120°, is very aesthetic and pleasing to users. In contrast, this attachment mode requires a large diameter of the barrel arbor, clearly larger than ten times the thickness of the barrel spring that is the standard, and therefore unduly reduces the volume of the barrel cage and the operating reserve of the movement, whereby the spring has fewer coils for a given space requirement of the barrel.

The device for attaching a winding ratchet to a barrel arbor, according to the invention, makes it possible to produce a unit that has the same aesthetics as those of the prior art, but whose barrel arbor can have a smaller diameter, determined in an optimal way, or about ten times the thickness of the barrel spring only, which, for a barrel cage of determined diameter, releases space and makes it possible to increase the number of coils of the barrel spring and therefore the operating reserve. The weight of the barrel arbor is also reduced.

The device for attaching a winding ratchet to a barrel arbor according to this invention comprises a particular ratchet, a barrel arbor whose end that bears the driving square has a particular shape, a driving washer, and screws.

Figure 1:
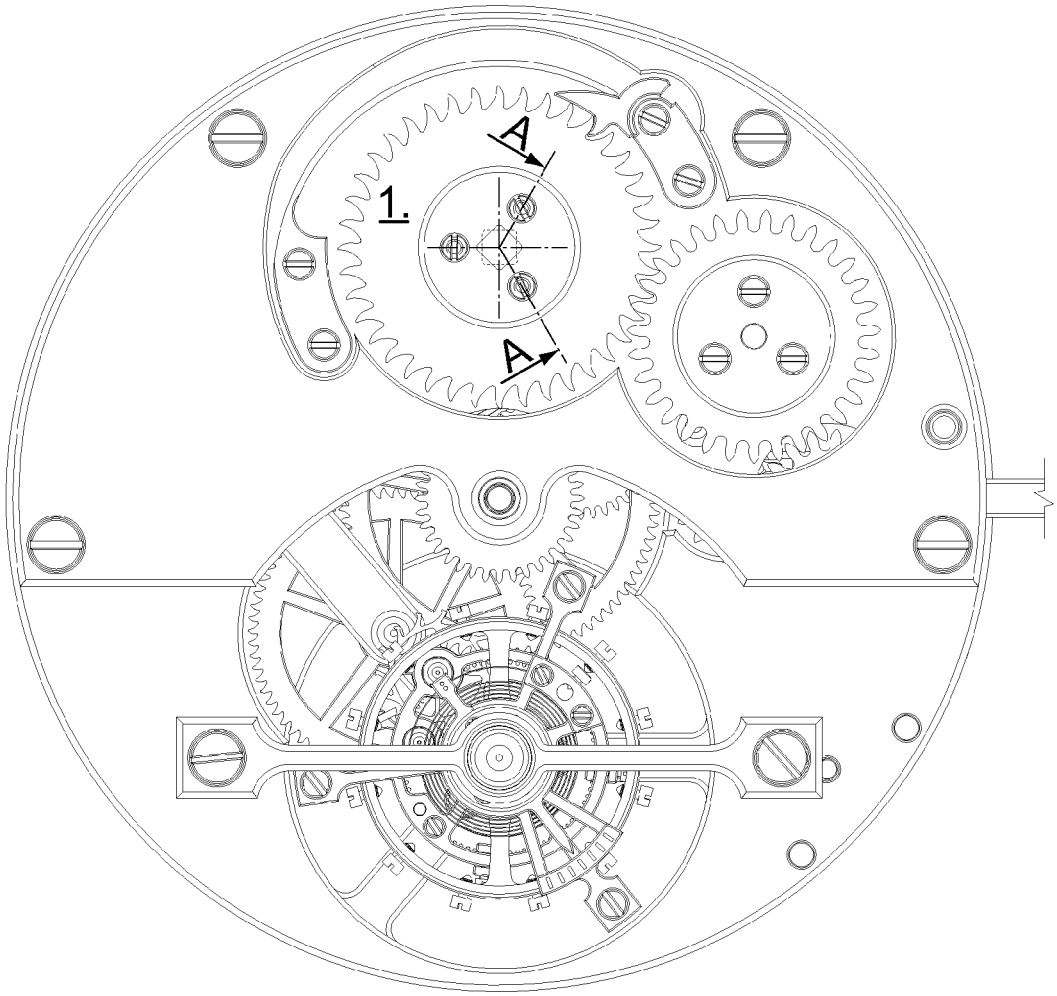
FIG. 1 is a top view of a top-quality clock movement in which the winding ratchet is attached to the barrel arbor using the device according to the invention.
Figure 2:
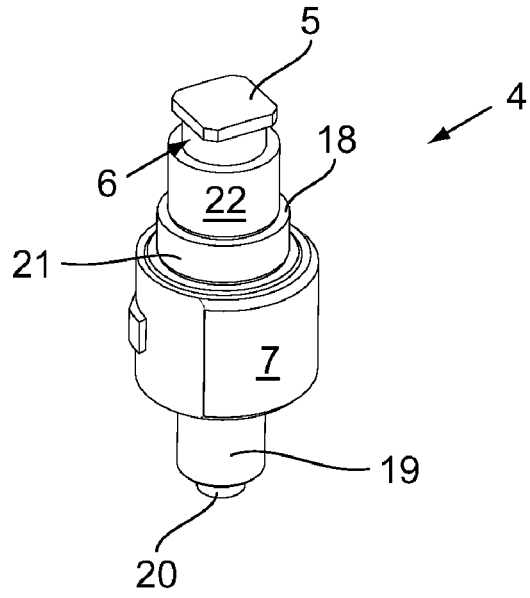
FIG. 2 illustrates a barrel arbor as is used in the unit that is produced according to the invention.
Figure 3:
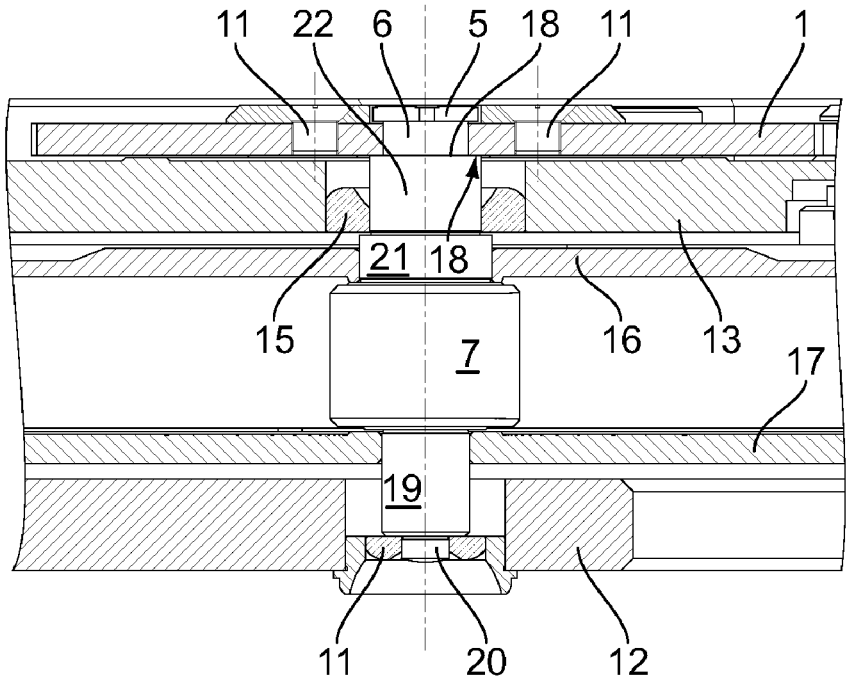
FIG. 3 is a partial cutaway along the line A-A of FIG. 1 showing the attachment of the winding ratchet on the barrel arbor.
Figure 4:
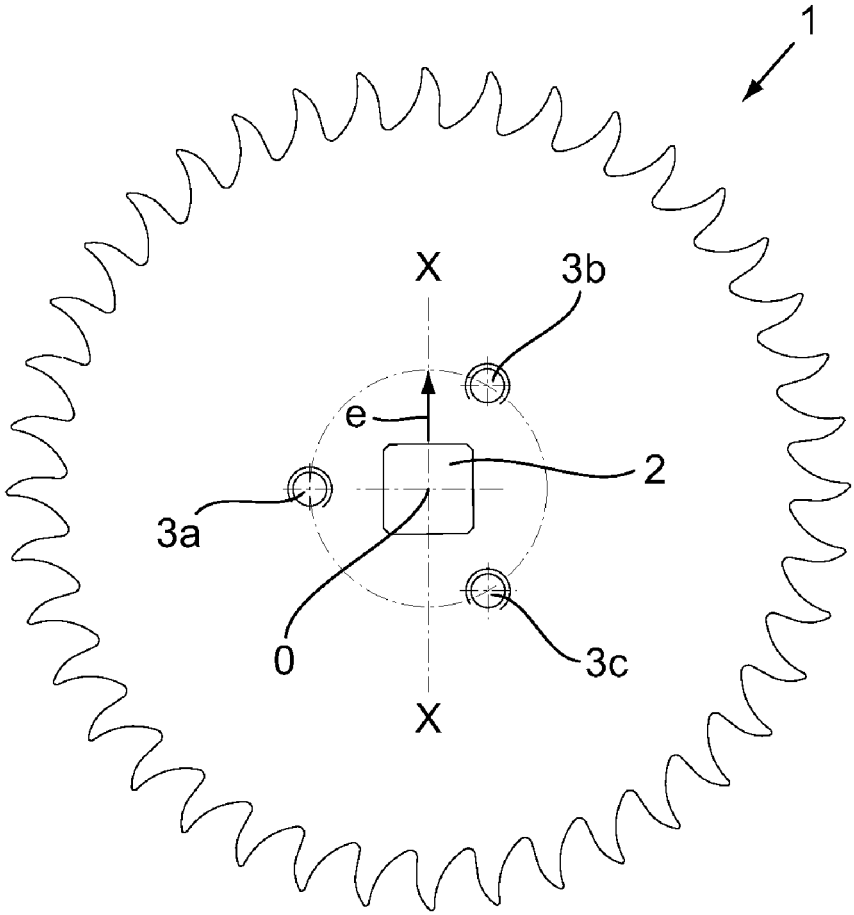
FIG. 4 illustrates in plan view the barrel ratchet according to the invention.
Figure 5:
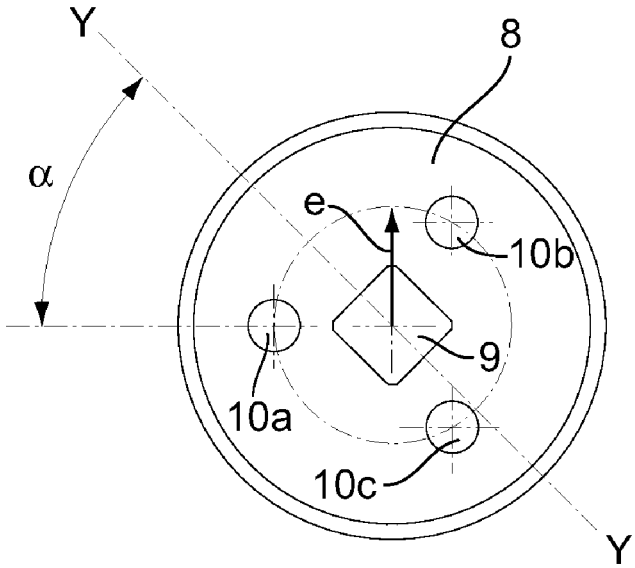
FIG. 5 illustrates an attachment plate of the device according to the invention.

The winding ratchet 1, depicted in plan view in FIG. 4, comprises an outside set of teeth and a square central opening 2 and tappings 3, three in the example that is depicted, uniformly distributed around the axis O of the winding ratchet 1. In the example that is depicted where the central opening is square and/or three screws are provided, one of the tappings 3*a* is centered on a radius of the ratchet 1 that passes through the center of one side of the opening 2 and the other two tappings are located on radii of the ratchet 1 forming an angle of 120° with the radius that passes through the tapping 3*a*.

At one of its ends, the barrel arbor 4 comprises a driving square 5, whose dimensions correspond to the central opening 2 of the ratchet to be able to pass through this central opening 2. At its end that comprises the driving square 5, the barrel arbor 4 comprises a groove 6 whose inside diameter is smaller than the length of one side of the driving square 5. The diameter of the median portion 7 of the barrel arbor 4 is larger than the one at the bottom of the groove 6 but is determined based on the thickness of the barrel spring. Generally, in an optimal way, this diameter is approximately equal to ten times the thickness of the barrel spring. This depends on, i.a., the material in which the barrel spring is produced.

The diameter of the bottom of the groove 6 of the barrel arbor 4 corresponds essentially to the length of a central opening side 2 of the winding ratchet respectively from the driving square 5 of the barrel arbor 4.

The attachment device according to the invention also comprises an attachment washer 8 that comprises a central passage 9 with a shape and dimension corresponding to the driving square 5 of the barrel arbor and the central opening 2 of the ratchet 1. This attachment washer 8 also comprises piercings 10, three in the example depicted, in a number that is equal to the number of tappings 3 of the ratchet 1. These piercings 10 are uniformly distributed around the center O' of this washer 8. These piercings 10 are located in a circle x with a diameter that is equal to the one y of the ratchet on which the tappings 3 are arranged. In contrast, the orientation of these piercings 10 relative to the central passage 9 of the washer 8 is different from the orientation of the tappings 3 relative to the central opening 2 of the ratchet 1. This difference in orientation that is shown by the angle $\alpha$ is between, for example, 15° and 30° in the example that is depicted. Thus, when the washer 8 is superposed on the ratchet 1 and when the piercings 10 are aligned on the tappings 3, the central opening 2 of the ratchet 1 is offset angularly relative to the central passage 9 of the washer 8.

The attachment device also comprises screws 11, three in the example that is depicted, which, in service position, pass through the piercings 10 of the washer 8 and are screwed into the tappings 3 of the ratchet 1.

The barrel arbor 4 is pivoted between the platen 12 and the barrel bridge 13 of a clock movement using stones 14, 15. The barrel arbor 4 is used as a pivot with the barrel cage formed by a cover 16 and a box 17. A barrel spring (not depicted) is attached by its inside end to the median part 7 of the barrel arbor 4 and by its outside coil to the side wall of the barrel box 17.

Once the barrel is mounted between the platen 12 and the barrel bridge 13, the square 5 from the barrel shaft 4 is passed through the central opening 2 of the ratchet 1 whose thickness is less than the height of the groove 6 of the barrel shaft 4. This ratchet 1 is then pivoted relative to the barrel arbor 4 by an angle $\alpha$ that is between 5° and 40°, preferably 15° to 30°, in the example that is depicted. In this way, the square central opening 2 of the ratchet is no longer aligned with the square 5 of the barrel arbor 4.

The square 5 of the barrel arbor 4 is then placed in the square passage of the attachment washer 8. The tappings 3 of the ratchet 1 are then aligned with the piercings 10 of the attachment washer 8, and the screws 11 are screwed into the tappings 3 of the ratchet that tightens this attachment plate 8 against the ratchet 1 and therefore makes it integral in rotation with the barrel arbor 4 via the square 5 that is engaged in the central passage 9 of the attachment washer 8. The ratchet is simultaneously limited in its axial movements relative to the barrel shaft by the lower surface of the square 5 of this barrel arbor and by the shoulder 18 of this barrel arbor that defines the height of the groove 6.

Owing to this attachment mode of the ratchet 1 on the end of the barrel arbor 4, the diameter of the barrel arbor 4 can be reduced, whereby the attachment screws 11 of the ratchet 1 no longer have to be screwed into the end of the barrel arbor 4. The diameter of the median part 7 of the barrel arbor can thus be determined based on the thickness of the barrel spring, generally on the order of ten times the thickness of said barrel spring, which leads to a large reduction of the diameter of this median part 7 of the barrel arbor relative to the conventional barrel arbors (see FIG. 6). Thus, the space that is available for the barrel spring in the barrel box 17 is larger; the spring can have more coils, and the operating reserve of the movement is increased for the same total space requirement of the barrel. The weight of the barrel arbor is reduced.

In variants, the end 5 of the barrel arbor 4 could be not square in shape but rather oval or polygonal, in a general way non-circular, provided that the shape of the central opening 2 of the ratchet 1 and the central passage 9 of the small attachment plate 8 is of corresponding shape.

In the embodiment that is described, the barrel arbor 4 comprises a median part 7 that accommodates the inside coil of a barrel spring (not depicted). From one side of this median part 7, the barrel arbor comprises a first cylindrical part 19 that serves as a bearing for the barrel box 17 and ends by a first journal 20 that is pivoted in the platen 12 of a movement by the stone 14. On the other side of this median part 7, the barrel arbor 4 has a second cylindrical part 21 that serves as a bearing for the barrel cover 16 followed by a second journal 22 that pivots in the barrel bridge 13 using the stone 15. This second journal 22 extends through the portion of the barrel arbor 4 that comprises the groove 6 and ends by the driving element of the ratchet 1, here the square 5.

The number of attachment screws 11 of the attachment washer 8 on the ratchet 1 can be different from three, for example two, four or five, but at least one.

The invention claimed is:

1. Unit that is formed by a winding ratchet and a barrel arbor, characterized by the fact that one of the ends of the barrel arbor comprises a driving formation that is non-circular in shape as well as a groove that is adjacent to this driving formation that defines a small-section portion of the barrel arbor whose shape and dimensions are such that they extend into the section of the driving formation, whereby a shoulder of the barrel arbor limits the height of said groove from the side facing said driving formation; by the fact that the ratchet comprises a central opening with a shape and dimension corresponding to the driving formation of the barrel arbor; by the fact that this ratchet comprises at least one off-centered tapping relative to the ratchet by a determined distance; by the fact that it comprises an attachment washer that has a central passage with a shape and dimension that correspond to the driving formation of the barrel arbor and is engaged with the latter in assembled position, as well as at least one off-centered piercing relative to said washer by a predetermined distance that is equal to the off-centering of the tapping of the ratchet; by the fact that it also comprises at least one screw that makes it possible to screw the attachment washer on the ratchet; and by the fact that the angular position of the piercings of the ratchet, relative to an axis of symmetry (x-x) of its central opening, is different from an angle ($\alpha$) of the angular position that the tappings of the attachment washer exhibit relative to the corresponding axis of symmetry (y-y) of the central passage of this attachment washer.

2. Unit according to claim 1, wherein the driving formation of the barrel arbor is a square.

3. Unit according to claim 2, wherein the central opening of the ratchet and the central passage of the attachment washer are square in shape and with a size that corresponds to the square of the barrel arbor (4).

4. Unit according to claim 1, wherein the number of piercings of the ratchet, the number of tappings of the attachment washer, and the number of screws is equal to three.

5. Unit according to claim 1, wherein the thickness of the ratchet corresponds to the height of the groove of the barrel arbor.

6. Unit according to claim 3, wherein the number of piercings of the ratchet, the number of tappings of the attachment washer, and the number of screws is equal to three.

7. Unit according to claim 2, wherein the thickness of the ratchet corresponds to the height of the groove of the barrel arbor.

8. Unit according to claim 3, wherein the thickness of the ratchet corresponds to the height of the groove of the barrel arbor.

9. Unit according to claim 4, wherein the thickness of the ratchet corresponds to the height of the groove of the barrel arbor.

10. Unit according to claim 6, wherein the thickness of the ratchet corresponds to the height of the groove of the barrel arbor.

11. Unit according to claim 1, wherein said barrel arbor further comprises a median part that is designed to accommodate the internal coil of a barrel spring that is located between two cylindrical portions that serve as a bearing for the box and the cover of a barrel, whereby one of these cylindrical portions is terminated by a pivot that forms one of the ends of the barrel arbor that is designed to pivot the barrel arbor in a platen of a clock movement; and wherein the other one of these cylindrical portions is terminated by the driving formation that is non-circular in shape and that forms the other end of the barrel arbor by the groove whose inside diameter is less than that of a circle that is inscribed in the form of the driving formation and whose height corresponds to the thickness of the ratchet that has to be attached to the barrel arbor.

* * * * *